US009764294B2

(12) United States Patent
Brown

(10) Patent No.: US 9,764,294 B2
(45) Date of Patent: Sep. 19, 2017

(54) LIQUID-GAS MIXER AND TURBULATOR THEREFOR

(75) Inventor: Christopher James Brown, Camarillo, CA (US)

(73) Assignee: PRATT & WHITNEY ROCKETDYNE, INC., Canoga Park, CA (US)

( * ) Notice: Subject to any disclaimer, the term of this patent is extended or adjusted under 35 U.S.C. 154(b) by 902 days.

(21) Appl. No.: 13/476,386

(22) Filed: May 21, 2012

(65) Prior Publication Data

US 2013/0307168 A1 Nov. 21, 2013

(51) Int. Cl.

| | |
|---|---|
| ***B01F 3/04*** | (2006.01) |
| ***F23D 11/10*** | (2006.01) |
| ***F23D 11/38*** | (2006.01) |
| *B01F 5/06* | (2006.01) |
| *B01F 15/02* | (2006.01) |
| *B01F 5/00* | (2006.01) |

(52) U.S. Cl.

CPC ..... *B01F 3/04737* (2013.01); *B01F 3/04056* (2013.01); *B01F 3/04439* (2013.01); *F23D 11/102* (2013.01); *F23D 11/38* (2013.01); *B01F 5/0616* (2013.01); *B01F 2005/0017* (2013.01); *B01F 2005/0639* (2013.01); *B01F 2015/0221* (2013.01)

(58) Field of Classification Search

CPC ..... B01F 5/04; B01F 5/0413; B01F 4/0428; F23R 3/28; F23R 4/286; F23R 3/343; F23R 3/14; F23R 3/00

See application file for complete search history.

(56) References Cited

U.S. PATENT DOCUMENTS

| | | | | |
|---|---|---|---|---|
| 2,605,611 | A | | 8/1952 | Wosika |
| 2,720,754 | A | | 10/1955 | Francois |
| 4,754,600 | A | | 7/1988 | Barbier et al. |
| 4,842,197 | A | | 6/1989 | Simon et al. |
| 5,129,226 | A | * | 7/1992 | Bigelow et al. ..... 60/765 |
| 5,251,447 | A | | 10/1993 | Joshi et al. |

(Continued)

FOREIGN PATENT DOCUMENTS

| | | | |
|---|---|---|---|
| EP | 2400220 | A2 | 12/2011 |
| WO | 2009126487 | A2 | 10/2009 |

(Continued)

OTHER PUBLICATIONS

International Search Report and Written Opinion for International Application No. PCT/US2013/039851 completed on Sep. 25, 2013.

(Continued)

*Primary Examiner* — Amber R Orlando

(74) *Attorney, Agent, or Firm* — Carlson, Gaskey & Olds P.C.

(57) ABSTRACT

Disclosed is a liquid-gas mixer including a central passageway provided about an injector axis, and first and second gas passageways. The first gas passageway is radially outward of the central passageway and radially inward of the second gas passageway. A turbulator is provided between the first and second gas passageways, and includes a plurality of first disturbance generators and a plurality of second disturbance generators. The first and second disturbance generators are provided about the turbulator in an alternating arrangement.

18 Claims, 3 Drawing Sheets

(56) References Cited

U.S. PATENT DOCUMENTS

| | | | | |
|---|---|---|---|---|
| 5,487,274 | A * | 1/1996 | Gulati et al. | 60/725 |
| 5,675,971 | A | 10/1997 | Angel et al. | |
| 5,966,937 | A * | 10/1999 | Graves | 60/748 |
| 6,820,411 | B2 | 11/2004 | Pederson et al. | |
| 7,546,734 | B2 | 6/2009 | Dorr et al. | |
| 7,954,325 | B2 | 6/2011 | Burd et al. | |
| 2009/0255242 | A1 * | 10/2009 | Paterson et al. | 60/320 |

FOREIGN PATENT DOCUMENTS

| | | | |
|---|---|---|---|
| WO | 2011104068 | A2 | 9/2011 |
| WO | 2012/047159 | A1 | 4/2012 |

OTHER PUBLICATIONS

Supplementary European Search Report for European Application No. 13794558.0 completed Dec. 15, 2015.

* cited by examiner

LIQUID-GAS MIXER AND TURBULATOR THEREFOR

GOVERNMENT CONTRACT

This invention was made with government support under Contract No. NNC10CA11C awarded by NASA. The Government has certain rights in this invention.

BACKGROUND

Industrial burners and engines, such as gas turbine engines, include combustors having liquid-gas mixers, such as fuel injectors, configured to mix a liquid, such as fuel, and gas, such as air, prior to combustion, for example. Some known liquid-gas mixers are configured to disturb a flow of gas, and to spray liquid into the disturbed gas. One known type of liquid-gas mixer includes a plate with a plurality of apertures, such that gas is disturbed as it passes through the apertures in the plate. Other liquid-gas mixers include swirlers configured to swirl a gas flow about an axis of the mixer.

SUMMARY

Disclosed is a liquid-gas mixer including a central passageway provided about an injector axis, and first and second gas passageways. The first gas passageway is radially outward of the central passageway and radially inward of the second gas passageway. A turbulator is provided between the first and second gas passageways. The turbulator includes a plurality of first disturbance generators and a plurality of second disturbance generators. The first and second disturbance generators are provided about the turbulator in an alternating arrangement.

In a further non-limiting embodiment of the foregoing liquid-gas mixer, the turbulator includes a main body portion having a free end and an end supported by a strut, the first and second disturbance generators extending in opposite directions from the free end of the main body portion.

In a further non-limiting embodiment of either of the foregoing liquid-gas mixers, the first disturbance generators extend radially inward from the free end of the main body portion into the first gas passageway.

In a further non-limiting embodiment of any of the foregoing liquid-gas mixers, the second disturbance generators extend radially outward from the free end of the main body portion into the second gas passageway.

In a further non-limiting embodiment of any of the foregoing liquid-gas mixers, adjacent ones of the first disturbance generators are spaced apart by one of the second disturbance generators.

In a further non-limiting embodiment of any of the foregoing liquid-gas mixers, the central passageway is configured to receive a flow of liquid, and wherein the first and second gas passageways are configured to receive respective gas flows.

In a further non-limiting embodiment of any of the foregoing liquid-gas mixers, the first and second disturbance generators are curved tabs.

In a further non-limiting embodiment of any of the foregoing liquid-gas mixers, the first and second disturbance generators are curved about respective curvature axes, the curvature axes being perpendicular to the injector axis.

Further disclosed is a mixer including a mixing chamber configured to collect liquid and gas, a central passageway provided about an injector axis, and a first gas passageway and a second gas passageway. The first gas passageway is radially outward of the central passageway and radially inward of the second gas passageway. Further, a turbulator is provided between the first and second gas passageways. The turbulator includes a plurality of first disturbance generators and a plurality of second disturbance generators. The first and second disturbance generators are provided about the turbulator in an alternating arrangement.

In a further non-limiting embodiment of the foregoing mixer, the turbulator includes a main body portion having a free end and an end supported by a strut, the first and second disturbance generators extending in opposite directions from the free end of the main body portion.

In a further non-limiting embodiment of either of the foregoing mixers, the liquid is fuel and wherein the gas is air.

In a further non-limiting embodiment of either of the foregoing liquid-gas mixers, the mixer further includes a central housing defining the central passageway, a mixing chamber housing defining the mixing chamber, and a strut connecting the central housing and the mixing chamber housing, the turbulator extending from the strut.

In a further non-limiting embodiment of either of the foregoing liquid-gas mixers, the first gas passageway is provided radially inward of the turbulator and radially outward of the central housing.

In a further non-limiting embodiment of either of the foregoing liquid-gas mixers, the second gas passageway is provided radially outward of the turbulator and radially inward of the mixing chamber housing.

In a further non-limiting embodiment of either of the foregoing liquid-gas mixers, adjacent first disturbance generators are spaced apart by one of the second disturbance generators.

In a further non-limiting embodiment of either of the foregoing liquid-gas mixers, the first and second disturbance generators are curved about respective curvature axes, the curvature axes being perpendicular to the injector axis.

Further disclosed is a method of mixing fuel and air for combustion. The method includes establishing a flow of fuel through a central passageway, establishing first and second air flows through first and second air passageways, respectively, and generating a plurality of vortexes in the first and second airflows. A turbulator generates the vortexes with a plurality of first disturbance generators and a plurality of second disturbance generators. The first and second disturbance generators are provided about the turbulator in an alternating arrangement.

In a further non-limiting embodiment of the foregoing method of mixing fuel and air for combustion, each of the first and second disturbance generators creates two oppositely-rotating vortexes.

In a further non-limiting embodiment of either of the foregoing methods of mixing fuel and air for combustion, the method further includes spraying the fuel toward the plurality of vortexes to mix the fuel with the first and second airflows.

In a further non-limiting embodiment of either of the foregoing methods of mixing fuel and air for combustion, the method further includes combusting the fuel-air mixture.

These and other features of the present disclosure can be best understood from the following drawings and detailed description.

BRIEF DESCRIPTION OF THE DRAWINGS

The drawings can be briefly described as follows.

DETAILED DESCRIPTION

Figure 1:
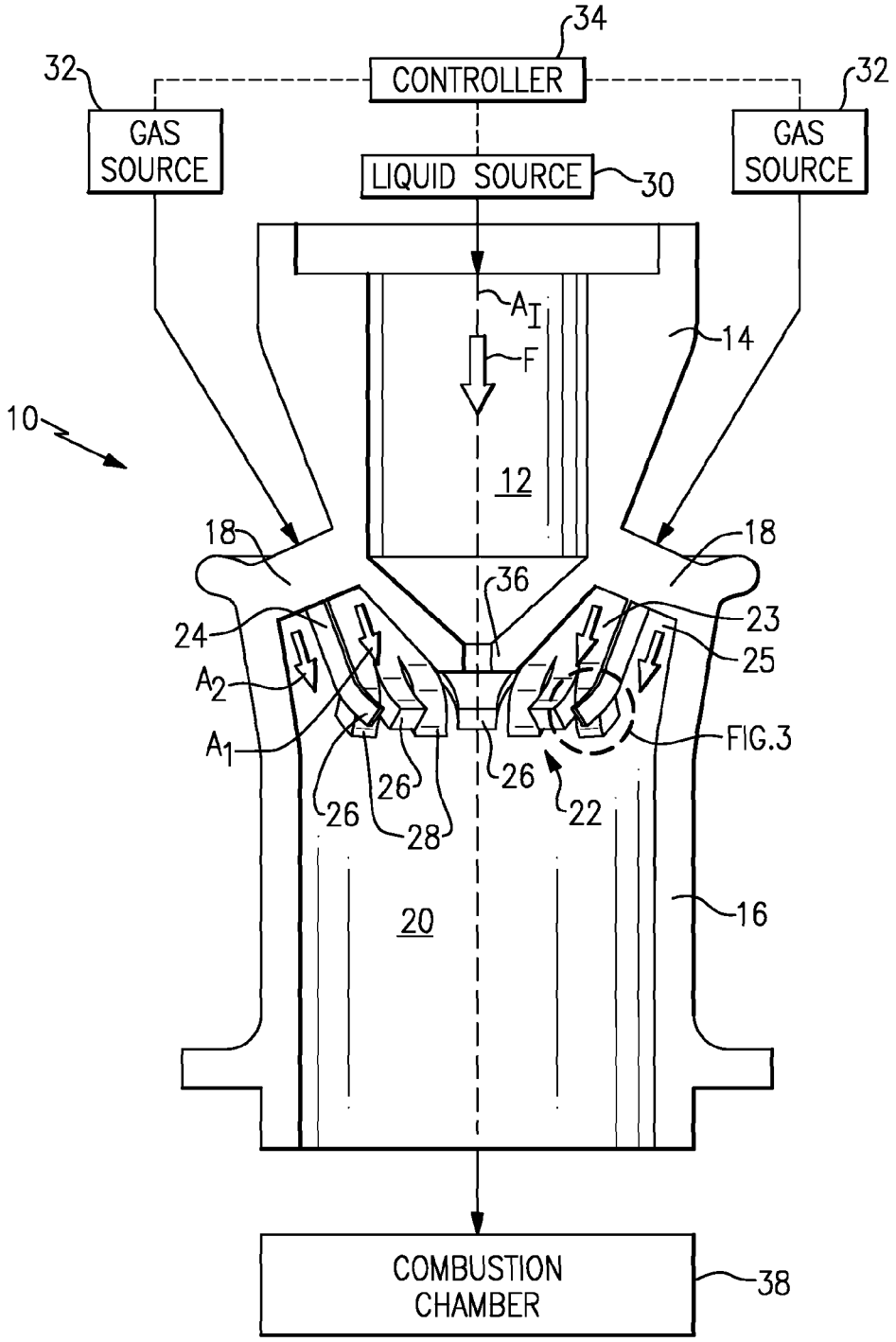
FIG. 1 is a cross-sectional view illustrating an example liquid-gas mixer.

FIG. 1 illustrates an example liquid-gas mixer 10. In this example, the liquid-gas mixer 10 is a fuel injector incorporated into a combustor of a gas turbine engine. In other examples, the liquid-gas mixer 10 is included in an industrial burner, or into the combustor of a rocket engine. The liquid-gas mixer 10 can be made of any suitable material, such as a high strength steel or a ceramic material.

The example liquid-gas mixer 10 is provided about a mixer axis $A_I$, and includes a central, liquid passageway 12 within a central housing 14. In this example, where the liquid-gas mixer 10 is a fuel injector, the liquid is fuel. The central housing 14 is connected to a mixing chamber housing 16 by way of a plurality of struts 18, and the mixing chamber housing 16 provides a mixing chamber 20 therein. A turbulator 22 provided radially between the central housing 14 and the mixing chamber housing 16 extends downward from the struts 18 and into the mixing chamber 20.

The turbulator 22 includes a main body portion 24, and a plurality of first and second disturbance generators 26, 28 at a free end of the main body portion 24. The first and second disturbance generators 26, 28 are provided in an alternating arrangement such that adjacent first disturbance generators 26 are spaced apart by a second disturbance generator 28.

Figure 2:
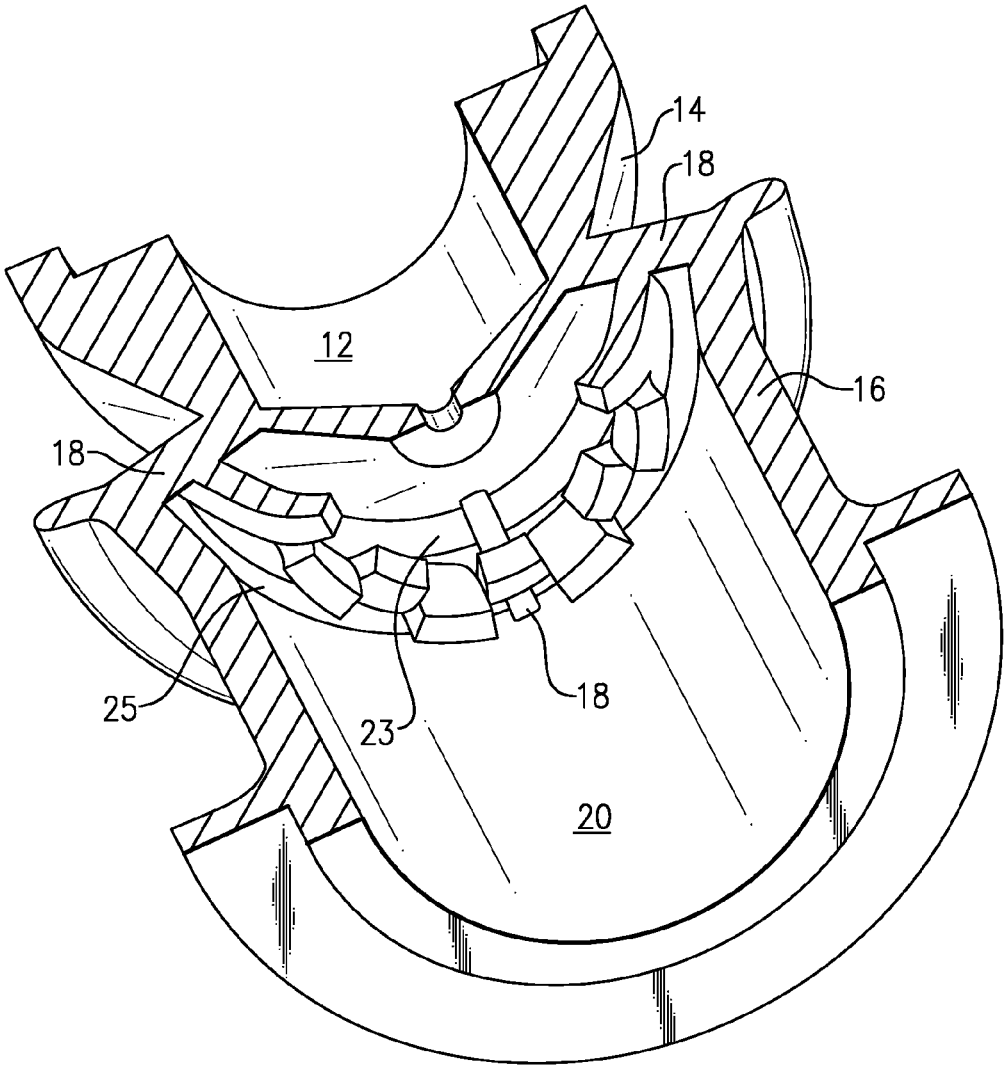
FIG. 2 is a perspective, cross-sectional view of the liquid-gas mixer of FIG. 1.

As best seen in FIG. 2, the turbulator 22 is positioned relative to the strut 18 so as to provide two gas passageways 23, 25 on either side thereof. In this example, where the liquid-gas mixer 10 is a fuel injector, the gas is air or some other type of oxidizer. As illustrated, a first gas passageway 23 is provided radially outward (e.g., relative to the injector axis $A_I$) of both the liquid passageway 12 and the central housing 14, and radially inward of the turbulator 22. A second gas passageway 25 is provided radially outward of the turbulator 22 and radially inward of the mixing chamber housing 16.

The first disturbance generators 26 extend from the free end of the main body portion 24 radially inward, toward the injector axis $A_I$ and into the first gas passageway 23. The second disturbance generators 28, on the other hand, extend from the free end of the main body portion 24 radially outward, away from the axis of the injector $A_I$ and into the second gas passageway 25.

Figure 3:
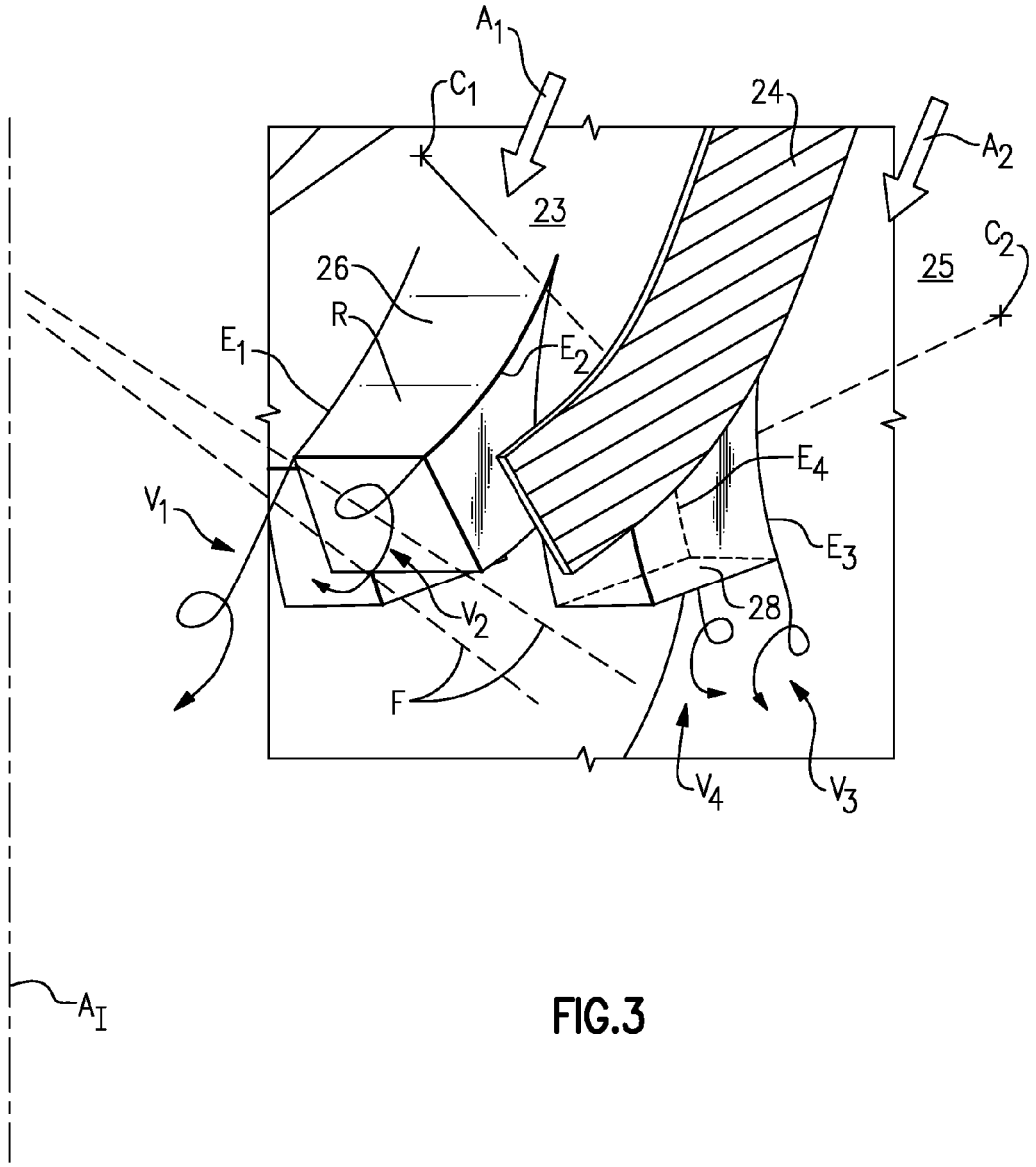
FIG. 3 is a close-up view showing the detail of the disturbance generators from FIG. 1.

In this example, the first and second disturbance generators 26, 28 are curved tabs. As shown in FIG. 3, the first disturbance generators 26 are curved about respective first axes of curvature $C_1$ that are perpendicular to the injector axis $A_I$. Likewise, the second disturbance generators 28 are curved about second axes of curvature $C_2$ that are also perpendicular to the injector axis $A_I$. The disturbance generators 26, 28 do not need to be curved, however, and can instead extend from the main body portion 24 in an angled, but flat orientation. Further, the disturbance generators 26, 28 do not need to be tabs, and can be any structures provided in an alternating arrangement, including alternating conical structures.

With reference to FIG. 1, the liquid-gas mixer 10 is in communication with a liquid source 30, and a gas source 32. The liquid and gas sources 30, 32 are in turn in communication with a controller 34. Again, in this example, the liquid is a fuel and the gas is air, however this application is not limited to fuel and air. The controller 34 can be any type of known controller, such as a computer including a processor and a computer readable medium, configured to control operation of the liquid source 30 and gas source 32 in a desired manner.

Liquid F is provided from the liquid source 30 to the liquid passageway 12 and flows downstream to a spray tip 36. The spray tip 36 directs the liquid F toward the mixing chamber 20 where the liquid F mixes with gas from the gas source 32. In one example, the liquid source 30 is controlled with the controller 34 such that the liquid F mixes with the gas at a point directly below the turbulator 22. While a spray tip 36 is shown, this application extends to examples that do not include spray tips.

The gas source 32 is controlled to provide gas into the first and second gas passageways 23, 25. In this example, the main body portion 24 of the turbulator 22 acts to bifurcate the gas from the gas source 32 into first and second gas flows $A_1$, $A_2$, which flow through the first and second passageways 23, 25, respectively. The first gas flow $A_I$ is disturbed by the first disturbance generators 26. The second disturbance generators 28 likewise disturb the second gas flow $A_2$. The detail of this interaction between the gas flows $A_1$, $A_2$ and the disturbance generators 26, 28 is illustrated in FIG. 3 and discussed below.

Turning to FIG. 3, the edges $E_1$ and $E_2$ of the first disturbance generator 26 cause the first gas flow $A_1$ to spin into two vortexes, $V_1$ and $V_2$, respectively. As illustrated, the vortexes $V_1$ and $V_2$ spin initially toward the middle of the ramp R created by the first disturbance generator 26, in opposite directions to one another, which leads to enhanced mixing. Similarly, the second gas flow $A_2$ is spun about vortexes $V_3$ and $V_4$ by way of the edges $E_3$ and $E_4$ of the second disturbance generator 28.

The above-discussed arrangement of the first disturbance generators 26 relative to the second disturbance generators 28 leads to enhanced mixing between the liquid F and the gas flows $A_1$, $A_2$ in the mixing chamber 20, prior to combustion. Downstream of the mixing chamber 20, the liquid-gas mixture flows to a combustion chamber 38 where the mixture is efficiently combusted and used for propulsion, for example.

It should be understood that while this application makes references to a "liquid passageway" and "gas passageways," that the fluids flowing through these passageways could be reversed (e.g., the gas could flow through the "liquid passageway" and vice versa) without compromising the mixing between the two fluids. Additionally, it is not necessary for the fuel to be liquid and the air to be gas, and in one example the above-described liquid-gas mixer can be used to effectively mix a liquid oxidizer and a gaseous fuel. Further, while reference herein has been made to "fuel" and "air," it should be understood that this application extends to other types of liquids and gasses, respectively.

It should further be understood that, although the figures have illustrated the liquid-gas mixer 10 as being generally cylindrical, oriented about the axis $A_1$, the turbulator 22 could be provided in any shape, including being generally flat, as long as the turbulator includes alternating first and second disturbance generators 26, 28 to disturb flows on either side thereof to improve mixing between a liquid and a gas.

Although the different examples have the specific components shown in the illustrations, embodiments of this invention are not limited to those particular combinations. It is possible to use some of the components or features from one of the examples in combination with features or components from another one of the examples.

One of ordinary skill in this art would understand that the above-described embodiments are exemplary and non-limiting. That is, modifications of this disclosure would come within the scope of the claims. Accordingly, the following claims should be studied to determine their true scope and content.

What is claimed is:

1. A liquid-gas mixer comprising:

a central passageway provided about an injector axis;

a first gas passageway and a second gas passageway, the first gas passageway radially outward of the central passageway and radially inward of the second gas passageway; and a turbulator provided between the first and second gas passageways, the turbulator including a plurality of first disturbance generators and a plurality of second disturbance generators, the first and second disturbance generators provided about the turbulator in an alternating arrangement; and wherein the first and second disturbance generators are curved tabs, each of the first disturbance generators curved about an axis of curvature located on the same side of the turbulator as the first air passageway, and each of the second disturbance generators curved about an axis of curvature located on the same side of the turbulator as the second air passageway.

2. The liquid-gas mixer as recited in claim 1, wherein the turbulator includes a main body portion having a free end and an end supported by a strut, the first and second disturbance generators extending in radially opposite directions from the free end of the main body portion.

3. The liquid-gas mixer as recited in claim 2, wherein the first disturbance generators extend radially inward from the free end of the main body portion into the first gas passageway.

4. The liquid-gas mixer as recited in claim 3, wherein the second disturbance generators extend radially outward from the free end of the main body portion into the second gas passageway.

5. The liquid-gas mixer as recited in claim 2, wherein adjacent ones of the first disturbance generators are spaced apart by one of the second disturbance generators.

6. The liquid-gas mixer as recited in claim 1, wherein the central passageway is configured to receive a flow of liquid, and wherein the first and second gas passageways are configured to receive respective gas flows.

7. A mixer comprising:

a mixing chamber configured to collect liquid and gas;

a central passageway provided about an injector axis;

a first gas passageway and a second gas passageway, the first gas passageway radially outward of the central passageway and radially inward of the second gas passageway; and a turbulator provided between the first and second gas passageways, the turbulator including a plurality of first disturbance generators and a plurality of second disturbance generators, the first and second disturbance generators provided about the turbulator in an alternating arrangement;

wherein the turbulator includes a main body portion having a free end and an end supported by a strut, the first and second disturbance generators extending in radially opposite directions from the free end of the main body portion; and wherein the first and second disturbance generators are curved tabs, each of the first disturbance generators curved about an axis of curvature located on the same side of the turbulator as the first air passageway, and each of the second disturbance generators curved about an axis of curvature located on the same side of the turbulator as the second air passageway.

8. The mixer as recited in claim 7, wherein the liquid is fuel and wherein the gas is air.

9. The mixer as recited in claim 7, further including:

a central housing defining the central passageway;

a mixing chamber housing defining the mixing chamber; and a strut connecting the central housing and the mixing chamber housing, the turbulator extending from the strut.

10. The mixer as recited in claim 9, wherein the first gas passageway is provided radially inward of the turbulator and radially outward of the central housing.

11. The mixer as recited in claim 10, wherein the second gas passageway is provided radially outward of the turbulator and radially inward of the mixing chamber housing.

12. A method of mixing fuel and air for combustion, comprising:

establishing a flow of fuel through a central passageway;

establishing first and second air flows through first and second air passageways, respectively; and generating a plurality of vortexes in the first and second airflows, wherein a turbulator generates the vortexes with a plurality of first disturbance generators and a plurality of second disturbance generators, the first and second disturbance generators provided about the turbulator in an alternating arrangement, wherein the first and second disturbance generators are curved tabs, each of the first disturbance generators curved about an axis of curvature located on the same side of the turbulator as the first air passageway, and each of the second disturbance generators curved about an axis of curvature located on the same side of the turbulator as the second air passageway.

13. The method as recited in claim 12, further including spraying the fuel toward the plurality of vortexes to mix the fuel with the first and second airflows.

14. The method as recited in claim 13, further including combusting the fuel-air mixture.

15. The liquid-gas mixer as recited in claim 1, further including a central housing defining the central passageway, a mixing chamber housing defining a mixing chamber, and a strut connecting the central housing and the mixing chamber housing, the turbulator extending from the strut.

16. The liquid-gas mixer as recited in claim 15, wherein the first gas passageway is provided radially inward of the turbulator and radially outward of the central housing, and wherein the second gas passageway is provided radially outward of the turbulator and radially inward of the mixing chamber housing.

17. The liquid-gas mixer as recited in claim 1, wherein the turbulator is configured to generate at least one vortex in the first gas passageway and at least one other vortex in the second gas passageway.

18. The liquid-gas mixer as recited in claim 15, wherein the turbulator includes a main body portion having a free end opposite the strut, the first and second disturbance generators extending in radially opposite directions from the free end of the main body portion, the free end spaced-apart from both the central housing and the mixing chamber housing.

* * * * *